US005415495A

United States Patent [19]

Johnson

[11] Patent Number: 5,415,495

[45] Date of Patent: May 16, 1995

[54] CUTTING MACHINE AND A METHOD FOR ITS USE

[75] Inventor: Henry M. Johnson, Loysville, Pa.

[73] Assignee: Surface Preparation Technologies, Inc., Mechanicsburg, Pa.

[21] Appl. No.: 93,159

[22] Filed: Jul. 19, 1993

[51] Int. Cl.[6] ..... E01C 23/09; E01C 23/16

[52] U.S. Cl. ..... 404/84.05; 404/90; 404/94

[58] Field of Search ..... 404/75, 84.05, 87, 90, 404/93, 94; 299/39

[56] References Cited

U.S. PATENT DOCUMENTS

| | | | |
|---|---|---|---|
| 4,701,069 | 10/1987 | Whitney | 404/94 X |
| 4,797,025 | 1/1989 | Kennedy | 404/90 |
| 4,854,769 | 8/1989 | Fukakawa et al. | 404/72 |
| 4,878,713 | 11/1989 | Zanetis | 299/39 |
| 4,900,094 | 2/1990 | Sergeant | 299/39 |
| 4,909,575 | 3/1990 | Lupton | 404/90 X |
| 5,094,565 | 3/1992 | Johnson | 404/75 |
| 5,104,195 | 4/1992 | Zaccho | 299/39 |
| 5,203,923 | 4/1993 | Hartman | 404/93 X |
| 5,215,071 | 6/1993 | Mertes et al. | 299/39 X |
| 5,297,894 | 3/1994 | Yenick | 299/39 X |

FOREIGN PATENT DOCUMENTS 0310074 4/1989 European Pat. Off. ..... 404/90

*Primary Examiner*—Ramon S. Britts
*Assistant Examiner*—James A. Lisehora
*Attorney, Agent, or Firm*—Foley & Lardner

[57] ABSTRACT

A cutting machine for cutting depressions in a road surface. The cutting machine includes a rotatable cutting head connect with a drive device for rotating the cutting head and an engaging device for moving the cutting head out of and into contact with the road surface. A power unit that moves the cutting head along the road surface is provided with a detector for continuously detecting a distance that the cutting head is moved by the power unit and for generating a signal indicative of the distance moved. An electronic controller, responsive to the signal, electronically controls the engaging device so that the cutting head moves out of and into contact with the road surface in accordance with the distance that the cutting head moves along the road surface and a specified dimensional profile of the depressions which are stored in the electronic controller. The movement of the cutting head cuts depressions in the road.

10 Claims, 4 Drawing Sheets

CUTTING MACHINE AND A METHOD FOR ITS USE

BACKGROUND OF THE INVENTION

1. Field of the Invention

This invention relates to a cutting tool for cutting a series of depressions along surfaces of roadways, and more particularly to a cutting tool which can automatically align itself with the surface being cut, thereby allowing it to continue to cut as it is moved forward.

2. Brief Description of the Prior Art

There has always been a concern that when a person is driving a vehicle it is often easy to drift off the road or over the center line and into the opposite lane of traffic, either of which can potentially lead to disastrous results. Therefore, a series of depressions are often cut along the shoulders or center line of the roadway and are referred to as ground in rumble strips. The purpose of the rumble strips is to alert drivers when they have drifted outside their traffic lane by creating a sound and causing vibration of the vehicle as the vehicle tires travel over the depressions.

A number of types of road surface grinders/cutting machines have heretofore been devised which use a cutting head or heads to cut individual depressions. The cutting heads are most often attached to or are part of a multipurpose power unit such as a tractor or skidsteer loader. The tractor or skidsteer loader is used to move the cutting head along the surface of the road and to provide any necessary utilities thereto, such as electricity or hydraulic fluid. The cutting head is then lowered into contact with the road surface to cut the depression.

Prior art cutting machines use a variety of methods for engaging and disengaging the cutting head into the road surface to cut the depression and for repositioning the cutting head for the next cut. One method of raising and lowering the cutting head requires an operator to manually control a hydraulic cylinder which is connected to the cutting head. A problem with this method is that it is difficult for the operator to move the cylinder controls quick enough to achieve a sufficient production rate.

An example of such a manually operated system is disclosed in U.S. Pat. No. 5,094,565 which utilizes a plurality of manually controlled cutting heads to cut a series of depressions at one time. The production rate is increased due to the use of the plurality of cutting heads, which are lowered onto the road surface to cut the depressions while the power unit is stationary. After the cut is complete, the cutting heads are raised and the power unit moves to the next location. Since there is not a continuous forward movement of the power unit, additional time is required for raising and lowering the cutting heads. Additionally, since the required sizing (depth, width, length, and radius of curvature of each depression) is specified depending on the task at hand, appropriately sized cutting heads must be used in order to meet the required dimensional sizing of the depressions. Thus, if different depression sizes are required, the cutting heads may have to be replaced.

In order to overcome some of the problems with the manual systems, automated means for raising and lowering the cutting head have been developed. Such means include rigidly connecting the cutting heads (1) to an eccentric wheel which rolls over the road surface or (2) to a cam and lever system. In each of these automated systems, the cutting head is automatically raised and lowered as the power unit moves forward due, respectively, to the rotation of the eccentric wheel and the action of the cam and levers. These systems are an improvement over the manually operated systems since the production rate of making depressions is increased because the cutting head cuts as the power unit moves forward. However, these automated systems for raising and lowering the cutting heads impose limitations above and beyond the cutting time required by the cutting head to complete its cut.

The maximum production rate of any cutting machine is limited by the amount of time required for the cutting head to complete each cut. Prior art systems, however, could not meet maximum production rates because of limitations imposed by the mechanical arrangements used to control the vertical motion of the grinding head. In addition, these mechanical arrangements are subject to excessive wear and maintenance.

Furthermore, the prior art cutting machines do not adequately self-align the cutting heads with the road surface, thereby requiring an operator to continuously monitor and manually adjust the cutting head as road surface changes, such as inclined surfaces; are encountered, in order to ensure the depressions are formed in accordance with specified dimensions.

Furthermore, it is often the case that the number of depressions in a given rumble strip and/or the size of the depressions in a given rumble strip are different depending on the job site. Accordingly, in order to accommodate these changes, the prior art systems require the replacement of the cutting head and/or a complete change of the mechanical control mechanism (eccentric wheel, cam/lever) in order to achieve the required depression sizing. Such reconfiguring of the cutting machine is time consuming and costly.

SUMMARY OF THE INVENTION

An object of the present invention is to provide means for electronically controlling the vertical motion of the cutting head of a cutting machine and automatically adjusting the cutting head to align with the contours of the road surface as it travels over the road surface. Both of these features allow the cutting process to progress more quickly and accurately than previous road cutting machines because they impose no limitations on the depression forming production rate beyond the cutting time required by the cutting head.

Still another object of the present invention is to provide a cutting machine which electronically controls the vertical movement of the cutting head into and out of contact with a road surface, thereby allowing a power unit and the cutting head to continuously progress forward as the cutting head cuts depressions.

These objects are met by providing a cutting machine for cutting depressions in a road surface which includes a rotatable cutting head; drive means for rotating the cutting head; engaging means for moving the cutting head out of and into contact with the road surface; means for moving the cutting head along the road surface; means for continuously detecting-the distance that the cutting head is moved by the moving means and for generating a signal indicative of the distance moved; electronic control means, responsive to the signal, for electronically controlling the engaging means to move the cutting head out of and into contact with the road surface in accordance with the distance that the cutting head moves along the road surface and a specified dimensional profile of the depressions which are stored in the electronic control means so that the depressions are cut, and means for continuously aligning the cutting head with a slope of the road surface.

A further object of the invention is to provide electronic feedback relative to movements of the cutting head, which feedback will be processed and displayed to the operator, thereby alerting him as to whether or not the cutting head has had sufficient time to complete the cutting cycle in relation to the forward speed of the entire cutting machine.

Another object of the invention is to utilize as much weight a possible to keep the cutting head engaged with the road surface.

Still another object of the invention is to provide means for both electronically and mechanically adjusting the cutting tool to vary both the depth and width of the depressions consistently across the length of the rumble strip as well as to vary the depth and width of the depressions inconsistently across the length of the rumble strip, as field conditions or job specifications require.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
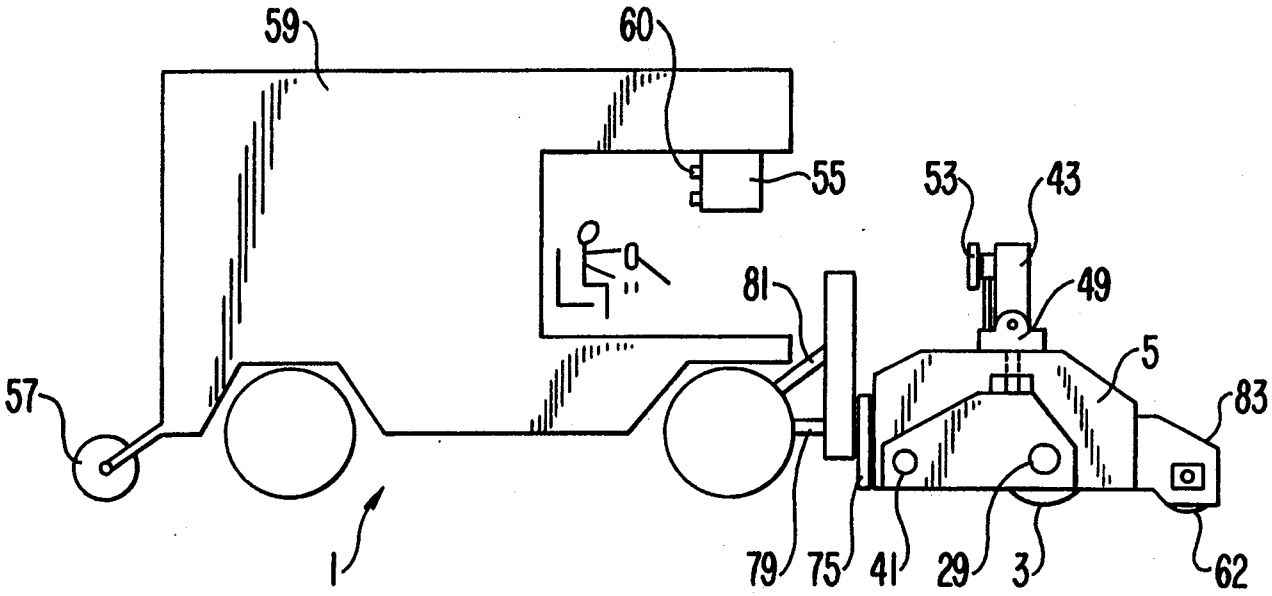
FIG. 1 is a right side view of the cutting machine.
Figure 2:
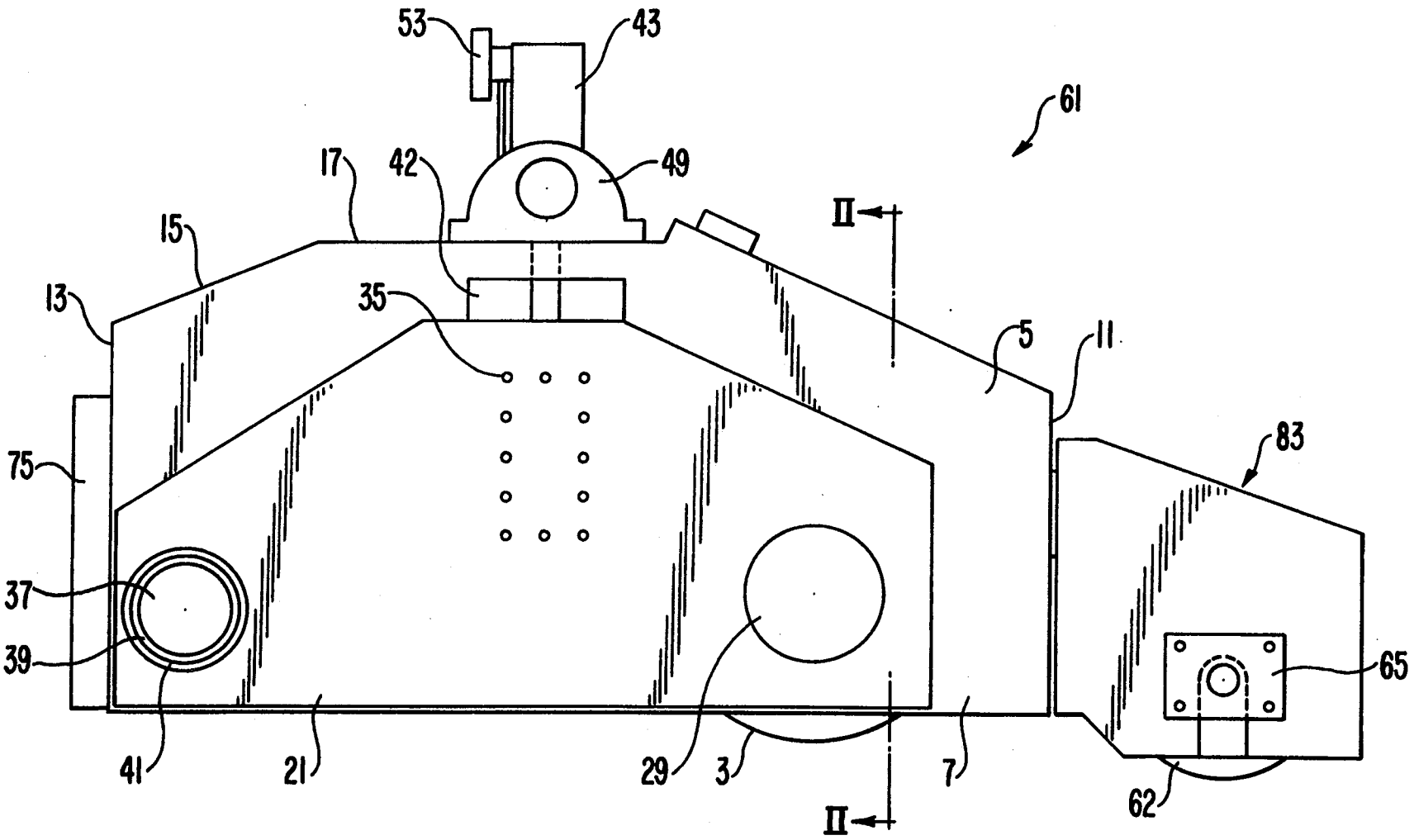
FIG. 2 is a right side view of the cutting apparatus.
Figure 3:
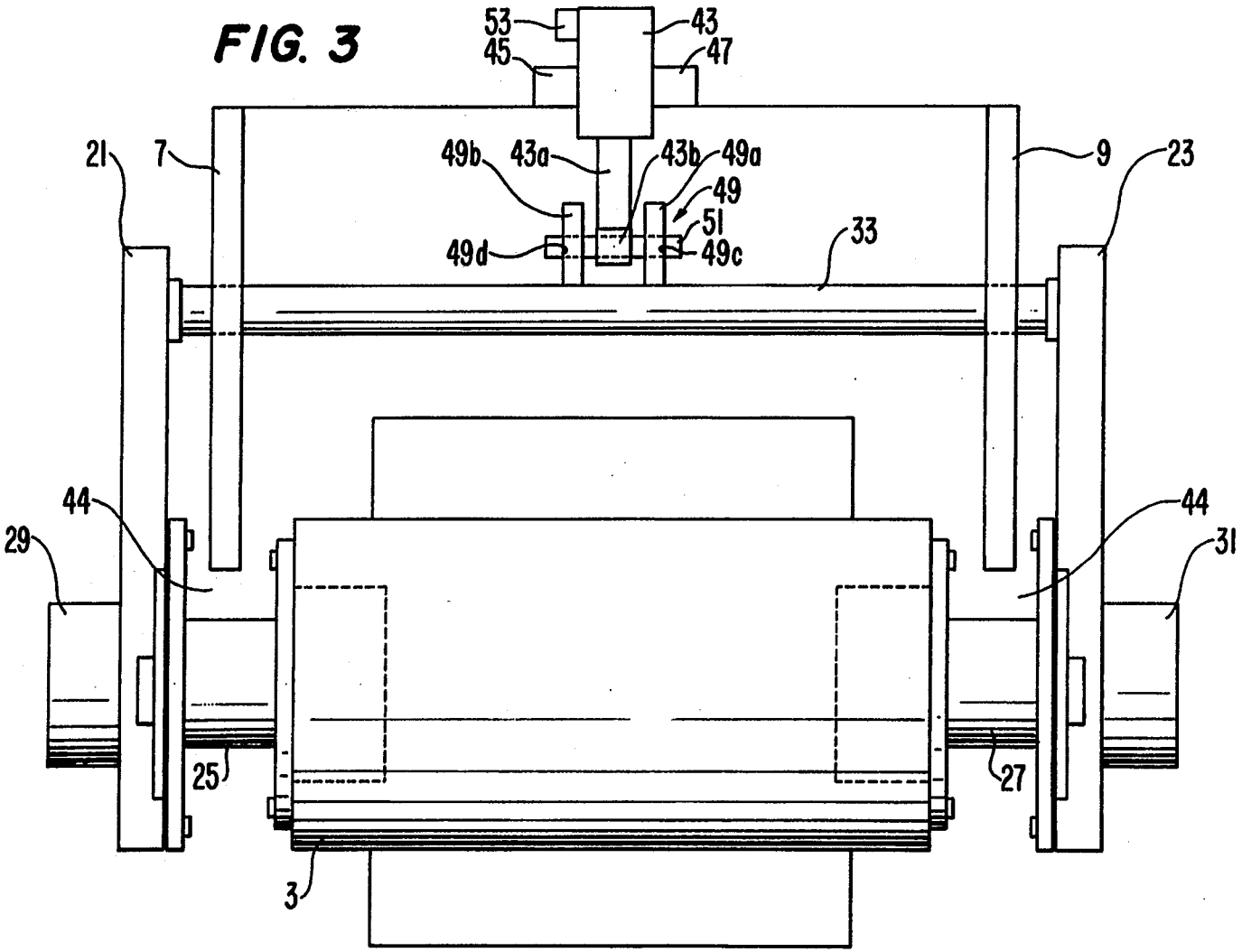
FIG. 3 is a front view of the cutting head within the cutting machine housing as seen along the section line II—II of FIG. 2.
Figure 4:
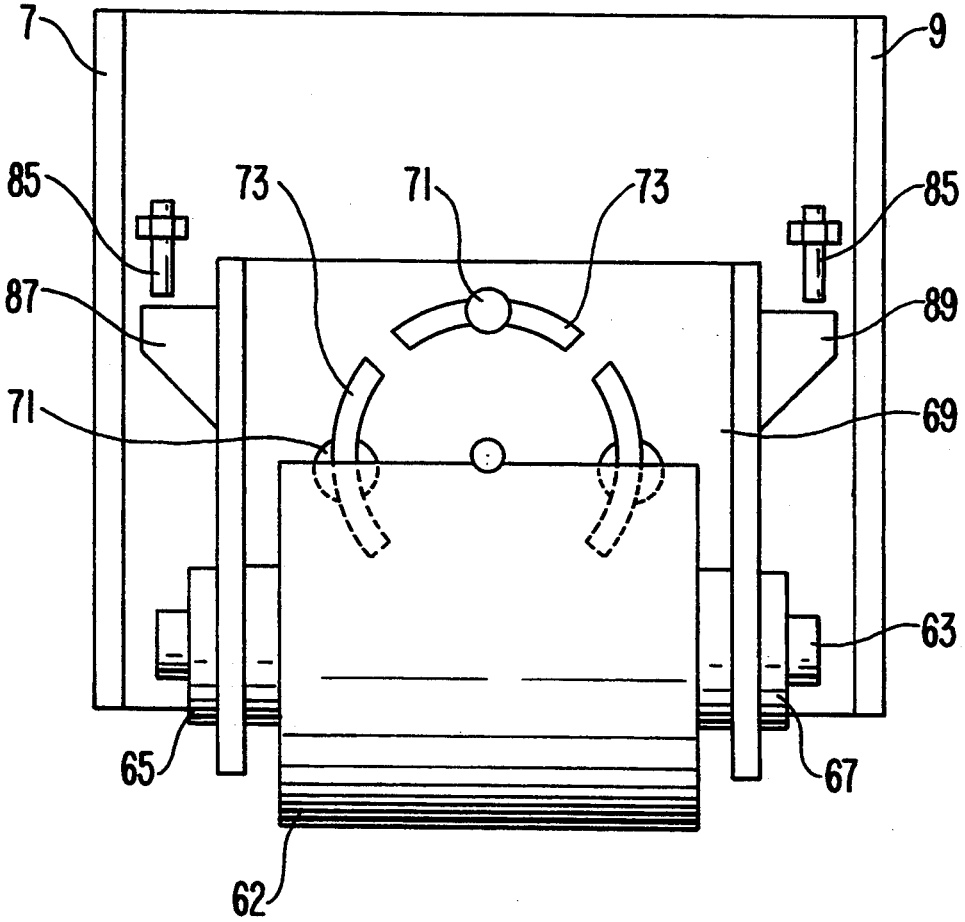
FIG. 4 is a front view of the front roller assembly.

Referring now to the drawings, and particularly to FIGS. 1–3, a cutting machine 1 includes a conventional cutting head/drum 3 contained within a housing weldment 5 having a pair of opposed, substantially parallel, vertically extending side walls 7 and 9. In addition, the housing weldment 5 contains front and rear parallel sidewalls 11 and 13, and two top plates 15, 17 forming part of the top of the housing 5. Access to the inside of the housing 5 from the top is accomplished via a door 19. The bottom of the housing 5 is completely open.

Referring to FIGS. 2 and 3, the cutting drum 3 is carried within the housing 5 by two arm plates 21 and 23. The cutting drum 3 is attached to each of the arm plates 21 and 23 through respective gear boxes 25 and 27 which contain bearings therein. The gear boxes 25 and 27 are each rigidly attached at one end thereof to the respective arm plate, which allows the opposite end of the gear boxes 25 and 27 to rotate the cutting drum 3. The cutting drum 3 is driven in a conventional manner by two hydraulic motors 29 and 31 which are respectively mounted through the arm plates 21 and 23 and into a respective gear box 25 and 27. The cutting drum 3 is rotated in a counter clockwise/up cut direction relative to a road surface, and uses conventional milling/mining tungsten carbide tipped teeth to cut with. Furthermore, while a hydraulic motor driven system for the cutting heads has been described, other conventional direct or indirect drive systems can be used in lieu thereof, such as a belt driven system.

The arm plates 21, 23 are interconnected at one end by the cutting drum 3 and drive mechanism described above. The arm plates 21, 23 are also interconnected by an I-beam 33 which is connected to each arm plate 21, 23 via bolts 35. The arm plates 21, 23 are also connected at the rear of the housing 5 by a solid shaft 37 which pivots against bearings 39, each of which are contained in a tube 41. The tube 41 is welded to and made part of the housing 5. The combination of the shaft 37, bearings 39 and tube 41 allows the cutting drum 3 and arm plates 21, 23 to pivot up and down. The up and down movement of the cutting drum 3 allows it to be engaged and disengaged with the road surface. Moreover, slots or opening 42 are provided in the side walls 7 and 9 to accommodate the movement of the I-beam 33. Additional slots or openings 44 which extend from the bottom edges of side walls 7, 9 allow for movement of the cutting drum 3 and drive mechanism without interference from the side walls 7, 9.

The cutting mechanism (cutting drum 3, arm plates 21, 23 and gear boxes 25, 27) is raised and lowered by a hydraulic cylinder 43 which is attached to the top plate 17 of the housing 5 by pillow block bearings 45 and 47 and to the I-Beam 33 at an attachment device 49. The attachment device 49 includes two lug portions **49*a*, 49*b* each having a through opening 49*c*, 49*d* therein. The piston 43*a* of hydraulic cylinder 43 has a through opening 43*b* which can be aligned with through openings 49*c*, 49*d*, such that a pin 51 passes through openings 49*c*, 49*d* and 43*b*, thereby connecting the hydraulic cylinder 43** to the cutting mechanism.

Control of the hydraulic cylinder 43 is accomplished via an electronic proportional valve 53. The electronic proportional valve 53 is activated to either raise or lower piston **43*a* of cylinder 43 according to programmed instructions from a computer controller 55. The computer controller 55 is programmed to precisely lower and raise the piston 43*a* to programmed depths as the cutting drum 3 advances across the road surface. The computer controller 55 receives electronic impulses which correspond to the distance traveled by the cutting machine 1 from a conventional wheel mounted encoder 57 which is disposed on the rear of a power unit 59. The power unit 59 can be a skidsteer loader or a tow tractor and provides utilities such as electricity or hydraulics to the various components of the cutting machine 1. The power unit 59 also moves the entire cutting machine 1 along the road surface. The encoder 57** is also referred to as a rotary pulse generator and is for example produced under the tradename "ROTODUCER" by Electronic Counter and Control Incorporated of Chesterland, Ohio.

Figure 5:
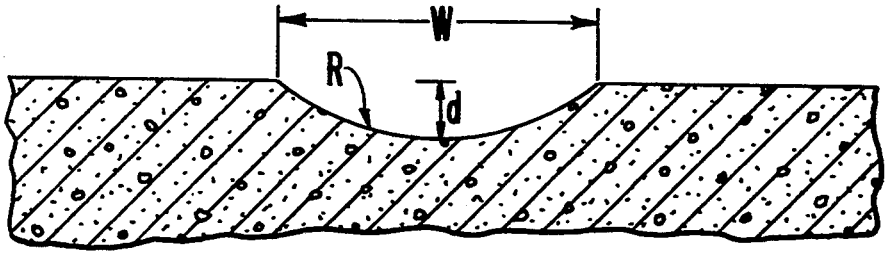
FIG. 5 is a cross-sectional view of a depression in a road surface.

As the forward speed of the power unit 59 changes, the rate of electronic impulses being received by the controller 55 from encoder 57, correspondingly changes, so that the distance traveled along the road surface by the cutting machine 1 is continuously calculated by the controller 55 based on the input from encoder 57. The computer controller 55 adjusts the speed at which the piston 43*a* of the cylinder 43 is raised and lowered in order to complete its preprogrammed cycle within the forward distance traveled. This rate of vertical motion directly corresponds to the forward speed of the machine. Thus, referring to FIG. 5, as the cutting drum 3 moves along the width "W" corresponding to the specified width of a depression, the hydraulic piston 43*a* is raised or lowered to obtain the required depression depth "d" in accordance with a specified radius of curvature "R".

Preprogrammed instructions pertaining to different cylinder 43 stroke cycles relative to required depression sizing are stored and saved in the computer controller 55. This allows the operator to quickly and easily adjust the depth and width of the cuts according to specifications or as field conditions require.

The hydraulic cylinder 43 is a type which contains conventional internal position sensors (not shown) which can provide electronic feedback to the computer controller 55 that is indicative of the position of piston 43*a*. This allows the computer controller 55 to check the actual stroke distance of the cylinder 43 as it travels, and to inform the machine operator by a series of lights 60 as to whether or not the cylinder completed its programmed cycle in accordance with the computer controller 55 instructions. Thus, for example, if the power unit 59 is moving too fast such that the cut cannot be completed as required, the operator will be alerted.

Referring now to FIGS. 1 through 4, the mobile power unit 59 pushes the entire cutting tool apparatus 61 across the road surface. The cutting tool apparatus 61 is supported on a front end thereof by a solid steel roller 62 which is affixed to a shaft 63 which is carried by two bearings 65 and 67. The bearings 65 and 67 are bolted to a roller housing assembly 69 which is firmly attached to the front of the cutter housing 5 by a series of bolts 71 and slots 73 formed in the roller housing assembly 69.

The entire cutting tool apparatus 61 via the housing 5, is attached to a mast 75 of the power unit 59 by a slew type bearing 77 which allows the cutting apparatus 61 to swivel horizontally. The mast 75 is also attached to the power unit 59 by hydraulic cylinders 79 and 81 (two of each, only 1 shown) and control arms (not shown). The height of the rear of the cutting tool apparatus 61 is adjusted by adjusting the mast cylinders 79. Once the height of the rear of the cutting apparatus 61 is adjusted, the lower mast cylinders 79 are pressurized in a manner which continuously tries to retract the bottom of the mast 75 toward the power unit 59. This feature has the affect of transferring the weight of the power unit 59 to the cutting apparatus 61, and thereby continuously forces the front roller 62 into maintaining contact with the road surface.

The weight transfer process discussed above allows for the weight of the power unit 59 to be transferred to the cutter housing 5. As much weight as possible must be applied on the housing 5 in order to ensure that the cutting drum 3 will be driven and held against the road surface during the required cutting cycle by the hydraulic cylinder 43. Sufficient weight is required so that the cutting cycle can be completed without the tool housing lifting up vertically.

The combination of the pressurized cylinders 79, the slew bearing 77 and the front roller assembly 83 enables the cutting tool apparatus 61 to self align with the road surface. As the cutting apparatus 61 is pushed along the surface of the road, the front roller 62 follows the horizontal plane of the road.

Due to the amount of weight placed on the cutting apparatus 61 due to the cylinders 79, the slew bearing 77 and the front roller assembly 83, the front roller 62 will almost always maintain contact across its width with whatever horizontal road plane it encounters. Since the tool cutting apparatus 61 is able to pivot horizontally about the slew bearing 77, the front roller assembly 83 continuously and automatically forces the cutter housing 5 and cutting drum 3 to be parallel to the road surface. In addition, the tool mast 75 can pivot vertically about the cylinders 79 and 81 via a conventional clevice type connection (not shown) that exists between the cylinders 79, 81 and the mast 75. This allows the cutting apparatus to adjust vertically if the cutting drum 3 is forced to move up or down due to a dip or rise in the road surface.

It is desirable that the cutting drum 3 be parallel to the road surface so that as the piston 43*a* of hydraulic cylinder 43 extends, the cutting drum 3 will engage the road surface and extend into the surface evenly across the length of the cut. The above-described levelling feature is self adjusting so that the operation of the cutting machine can meet and maintain a maximum forward speed and a maximum production capability.

An additional feature of the front roller assembly 83 is that it can be reorientated and locked relative to the cutter housing 5 such that the front roller 62 continues to follow the plane of the road surface, but the front roller assembly 83 will force the orientation of the cutter housing 5 and cutter drum 3 in a manner which is not parallel with the underlying road surface. The manual adjustment of the front roller assembly 83 requires loosening the front roller attachment bolts 71, rotating the front roller assembly 83 as required, and retightening the bolts 71 to relock the front roller assembly 83 to the cutter housing 5. Threaded roads 85 are then adjusted within corresponding threaded receptacles 86 until they abut against stops 87 and 89 to further reinforce the locked position of the front roller assembly 83.

The ability to reposition the front roller assembly 83 is required in the event that the specification for the cut requires the depression be wider and deeper on one side than on an opposite side thereof. By orientating the cutting drum 3 in a non-parallel manner relative to the underlying road surface, the cutting drum 3 is effectively located closer to the surface at one end thereof as compared to the other end. As the cylinder piston 43*a* extends the cutting drum 3 to engage the road surface, the cutting drum 3 is actually extended deeper into the road surface on one side of the cut than on the opposite side of the cut.

In operation, the operator first orientates the power unit 59 and cutting apparatus 61 over the area to be cut. The cutting drum 3 is suspended and held by the tool cylinder 43 at a hover point above the road surface. Then, the cutting drum 3 is generally orientated parallel to the road surface by adjusting the front roller assembly 83. However, as mentioned above, the front roller assembly 83 can be adjusted such that the cutting drum 3 is not parallel to the underlying surface in the event that a specification or road condition requires a cut which is inconsistent across its length. The operator then engages the drive mechanism of the power unit 59 and moves the cutting apparatus 61 forward. As the power unit 59 advances, the encoder 57 instructs the computer controller 55 to begin executing its programmed instructions and provides a signal to the controller 55 which is indicative of the distance traveled along the road surface. The computer controller 55, based on the signal from the encoder 57, sends signals to the proportional valve 53 which controls the movement of the piston 43*a* of tool cylinder 43, such that the cutting drum 3 is vertically moved into and out of contact with the road surface in a precise manner as it moves across the road surface. The movement of the piston 43*a* is set at a rate which is proportional to the forward speed of the power unit. In other words, the encoder continually supplies the computer with a signal indicative of detected forward movement of the power unit 59 and the computer controller 55 adjusts the piston 43*a* in relation to the forward movement such that the specified depression cut size is obtained.

The operator steers the power unit 59 to maintain the alignment of the cuts and monitors the computer to ensure that the program cycles are being completed. The operator further controls the operation by adjusting the maximum forward speed and production rate of the cutting machine 1 according to such things as road surface density or hardness. For example, if the road surface is easier to cut because it is soft, the operator will advance the power unit 59 forward at a faster rate in order to increase production. Moreover, due to the self-aligning features of the tool housing 5, the housing 5 will continuously self-adjust itself both horizontally and vertically to the road surface which allows the operator to proceed without stopping to make adjustments to the housing orientation. The resulting pattern left by the cutting apparatus 61 is a series of rumble strip depressions which are typically spaced twelve inches on center.

While a single embodiment of the invention has been described, it will be understood that it is capable of still further modifications, and this application is intended to cover any variations, uses, or adaptations of the invention, following in general the principles of the invention and including such departures from the present disclosure as to come with the knowledge of customary practice in the art to which the invention pertains, and as may be applied to the essential features herein before set forth and falling within the scope of the invention or the limits of the appended claims.

What is claimed is:

1. A cutting machine for cutting depressions in a road surface, comprising:

a rotatable cutting head;

drive means for rotating said cutting head;

engaging means for moving said cutting head out of and into contact with the road surface;

means for moving said cutting head along the road surface;

means for continually detecting the distance that said cutting head is moved by said moving means and for generating a signal indicative of the distance moved;

electronic control means, responsive to said signal, for electronically controlling said engaging means so that said cutting head moves out of and into contact with the road surface in accordance with the distance that said cutting head moves along the road surface and in accordance with a specified dimensional profile of said depressions which are stored in said electronic control means, thereby cutting said depressions;

means for continuously aligning said cutting head with a slope of the road surface; and a housing in which said cutting head is mounted, and means for adjustably mounting said front roller assembly on said housing;

wherein said front roller assembly includes a roller rotatably mounted in a frame, said frame having adjusting slots therein and being connected to said housing via bolts which pass through said slots and into corresponding openings in said housing; and wherein said housing includes first and second adjustable screws attached thereto, said frame further includes first and second stop members mounted thereon, and said first and second screws are each adjustable to contact a corresponding one of said stop members to lock said frame in place relative to said housing.

2. A cutting machine as recited in claim 1, wherein said means for continuously aligning includes a slew type bearing which is connected to said cutting head and said means for moving.

3. A cutting machine for cutting depressions in a road surface, comprising:

a rotatable cutting head;

drive means for rotating said cutting head;

engaging means for moving said cutting head out of and into contact with the road surface;

means for moving said cutting head along the road surface;

means for continuously detecting a distance that said cutting head is moved by said moving means and for generating a signal indicative of the distance moved; and electronic control means, responsive to said signal, for electronically controlling said engaging means so that said cutting head moves out of and into contact with the road surface in accordance with the distance that said cutting head moves along the road surface and in accordance with a specified dimensional profile of said depressions which are stored in said electronic control means, thereby cutting said depressions;

wherein said rotatable cutting head is mounted within a housing having four walls and said engaging means includes a first hydraulic cylinder mounted on said housing and connected to said cutting head such that as said hydraulic cylinder moves a stroke distance under control of said electronic control means, said cutting head moves relative to said housing.

4. A cutting machine as recited in claim 3, wherein said moving means is a power unit, said detecting means is an encoder and said electronic control means is a computer.

5. A cutting machine as recited in claim 4, further comprising pivoting means for allowing said cutting head to pivot relative to said housing, said pivoting means including a shaft rotatably mounted in said housing and connected to said cutting head.

6. A cutting machine as recited in claim 4, wherein said power unit includes a mast which is connected to said housing, and a second hydraulic cylinder which is connected to said mast and which is pressurized to apply a force to said mast which transfers the weight of said power unit to said housing in opposition to the upward movement of said housing away from the road surface.

7. A cutting machine as recited in claim 3, further comprising means for warning that said cutting head has not moved as directed by said electronic control means, said warning means including a sensor which detects a stroke movement of said first hydraulic cylinder and provides a signal indicative of the stroke movement to said electronic control means.

8. A method for cutting depressions in a road surface including:

moving a cutting head along the road surface;

continuously detecting the distance the cutting head moves along the road surface and supplying electronic impulses representative of a distance moved by the cutting head to an electronic control means;

electronically controlling movement of the cutting head into and out of engagement with the road surface using said electronic control means, said movement into and out of engagement being based upon the detected distance moved along the road surface and a dimensional profile of the depressions stored within said electronic control means, such that the depressions are cut to yield said dimensional profile irrespective of variations in a travel speed of said cutting head relative to said road surface; and mounting said cutting head within a housing having four walls such that when the cutting head is moved into and out of engagement with the road surface, said cutting head moves relative to said housing.

9. A method for cutting depressions as recited in claim 8, further comprising the step of automatically aligning the cutting head to be parallel with the road surface as the cutting head moves along the road surface.

10. A method for cutting depressions as recited in claim 8, further comprising the step of adjusting the cutting head so that it is not parallel with the road surface in order to cut depressions of varying depth along a length of the depressions.

* * * * *